US006582200B2

(12) United States Patent
Kato et al.

(10) Patent No.: US 6,582,200 B2
(45) Date of Patent: Jun. 24, 2003

(54) SWASH PLATE COMPRESSOR HAVING SHOES MADE OF A MAGNESIUM-BASED MATERIAL

(75) Inventors: Takayuki Kato, Kariya (JP); Takahiro Suqioka, Kariya (JP); Hiroaki Kayukawa, Kariya (JP); Masahiro Kawaguchi, Kariya (JP); Manabu Sugiura, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/888,817

(22) Filed: Jun. 25, 2001

(65) Prior Publication Data

US 2002/0006336 A1 Jan. 17, 2002

(30) Foreign Application Priority Data

Jul. 14, 2000 (JP) ..... 2000-214236

(51) Int. Cl.[7] ..... F04B 1/26
(52) U.S. Cl. ..... 417/222.2; 91/499; 92/71
(58) Field of Search ..... 417/269, 222.2; 91/499; 92/71, 187

(56) References Cited

U.S. PATENT DOCUMENTS 5,616,008 A * 4/1997 Yokono et al. ..... 417/222.2
5,915,928 A * 6/1999 Murase et al. ..... 92/71
6,189,434 B1 * 2/2001 Kawaguchi et al. ..... 92/71
6,308,615 B1 * 10/2001 Takenaka et al. ..... 92/71
6,415,705 B1 * 7/2002 Kato et al. ..... 92/71

FOREIGN PATENT DOCUMENTS

JP U-57-42180 3/1982
JP A-10-68380 3/1998

OTHER PUBLICATIONS

CRC Handbook of Chemistry and Physics and American Chemical Society, Dec. 19, 1997, Internet Periodic Table—Magnesium, 2 pages.*

* cited by examiner

*Primary Examiner*—Charles G. Freay
*Assistant Examiner*—John Belena
(74) *Attorney, Agent, or Firm*—Woodcock Washburn LLP

(57) ABSTRACT

A swash plate compressor provided with a housing internally defining and forming cylinder bores, a crank chamber, a suction chamber, and a discharge chamber; pistons accommodated in the cylinder bores to be able to reciprocate in them; a drive shaft driven by an external drive source and supported by the housing; a swash plate synchronously rotatably supported with respect to the drive shaft; and shoes at the front and rear of the swash plate for driving the pistons; wherein the shoes are mainly comprised of a magnesium-based material.

4 Claims, 3 Drawing Sheets

SWASH PLATE COMPRESSOR HAVING SHOES MADE OF A MAGNESIUM-BASED MATERIAL

BACKGROUND OF THE INVENTION

1. Field of the Invention

The present invention relates to a swash plate compressor used for a vehicle air-conditioning system etc.

2. Description of the Related Art

A refrigeration circuit used in a vehicle air-conditioning system includes a compressor for compressing a refrigerant gas. This compressor comes in various forms such as variable displacement types and fixed displacement types. More specifically, fixed displacement type compressors include not only single-headed piston type swash plate compressors, but also double-headed piston type swash plate types. Variable displacement type compressors also include not only single-headed piston type swash plate compressors, but also double-headed piston type swash plate compressors.

Among these compressors, a general swash plate compressor defines and forms, inside its housing, cylinder bores, a crank chamber, a suction chamber, and a discharge chamber. Each cylinder bore accommodates a piston so that it may reciprocate. Further, a drive shaft supported rotatably by the housing is driven by an engine or another external drive source. The swash plate is supported to be able to synchronously rotate with respect to the drive shaft. A pair of shoes is accomodated in a pair of shoe seats provided at an engagement portion in the piston to drive the pistons and is provided at the front and rear of the swash plate.

If the swash plate is inclined at a certain angle with respect to the drive shaft, the compressor is a fixed displacement swash plate compressor. If the inclination angle of the swash plate is variable with respect to the drive shaft and the pressure in the crank chamber can be adjusted by a control valve to change the inclination angle and adjust the discharge capacity, the compressor is a variable displacement swash plate compressor. On the other hand, if the piston is a single-headed piston having a head at only one of the front and rear of the swash plate, the compressor is a single-headed piston type swash plate compressor. If the piston is a double-headed piston having heads at both the front and rear of the swash plate, it is a double-headed piston type swash plate compressor.

In this swash plate compressor, if the drive shaft is driven by an external drive source, the swash plate synchronously rotates, so the pistons reciprocate in the cylinder bores through shoes. Due to this, each cylinder bore forms a compression chamber with the head of the piston, so when the piston is in the suction stroke, low pressure refrigerant gas is sucked by the piston from the suction chamber connected to an evaporator of the refrigeration circuit. When the piston is in the compression stroke, high pressure refrigerant gas is discharged to the discharge chamber from the compression chamber. This discharge chamber is connected to a condenser of the refrigeration circuit. The refrigeration circuit is used as a vehicle air-conditioning system for air-conditioning a vehicle. During this time, in the swash plate compressor, the slidability of the sliding portions between the swash plate and the shoes is ensured by a mist of lubricating oil contained in the refrigerant gas.

In the above swash plate compressors of the related art, however, the shoes were mainly comprised of a ferrous material, such as SUJ2 according to Japan Industrial Standards (JIS), and had the disadvantage that they were heavy. This disadvantage was present in both fixed displacement swash plate compressors and variable displacement swash plate compressors. Further, it similarly was present in single-headed piston type swash plate compressors using single-headed pistons and double-headed piston type swash plate compressors using double-headed pistons.

SUMMARY OF THE INVENTION

An object of the present invention is to provide a lighter swash plate compressor.

According to the present invention, there is provided a swash plate compressor provided with a housing internally defining and forming cylinder bores, a crank chamber, a suction chamber, and a discharge chamber; piston accommodated in each cylinder bore to be able to reciprocate therein; a drive shaft driven by an external drive source and supported by the housing; a swash plate synchronously rotatably supported with respect to the drive shaft; and a pair of shoes provided at the front and rear of the swash plate for connectingly driving the pistons; wherein the shoes are mainly comprised of a magnesium-based material.

Preferably, each shoe is comprised of a shoe substrate comprised of a magnesium-based material and a coating formed on the surface of the shoe substrate for improving the slidability.

Alternatively, each shoe is comprised of a shoe substrate comprised of a magnesium-based material and a coating formed on the surface of the shoe substrate for improving the slidability, and the inclination angle of the variable swash plate is variable with respect to the drive shaft and the pressure in the crank chamber can be adjusted by a control valve to change the inclination angle and adjust the discharge capacity.

Alternatively, each shoe is comprised of a shoe substrate comprised of a magnesium-based material and a coating formed on the surface of the shoe substrate for improving the slidability; the inclination angle of the swash plate is variable with respect to the drive shaft and the pressure in the crank chamber can be adjusted by a control valve to change the inclination angle and adjust the discharge capacity; and the piston is a single-headed piston having a head at only one of the front and rear of the swash plate.

BRIEF DESCRIPTION OF THE DRAWINGS

These and other objects and features of the present invention will be more apparent from the following description, with reference to the accompanying drawings, wherein.

DESCRIPTION OF THE PREFERRED EMBODIMENTS

Figure 1:
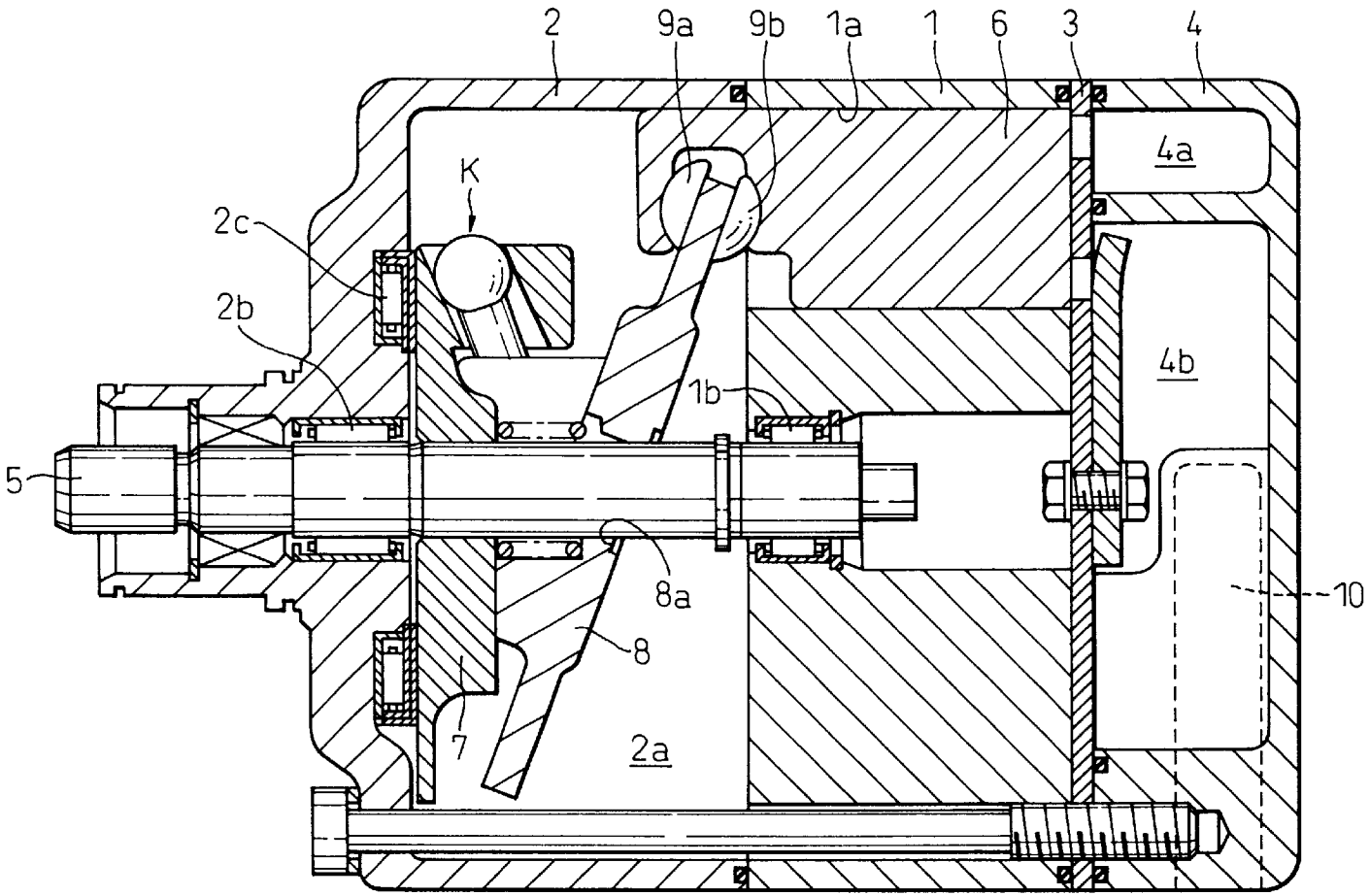
FIG. 1 is a sectional view of a variable displacement single-headed piston type swash plate type compressor according to an embodiment of the present invention.

The swash plate compressor according to the present invention is provided with a housing internally defining and forming cylinder bores, a crank chamber, a suction chamber, and a discharge chamber; a piston accommodated in each cylinder bore and able to reciprocate therein; a drive shaft driven by an external drive source and rotatably supported by the housing; a swash plate synchronously rotatably supported with respect to the drive shaft; and a pair of shoes at the front and rear of the swash plate and connectingly driving each piston; wherein the shoes are mainly comprised of a magnesium-based material.

The swash plate compressor of the present invention is reduced in weight since the shoes are mainly comprised of a magnesium-based material.

As the magnesium-based material (meaning magnesium or a magnesium alloy containing mostly magnesium, same below), it is possible to use AZ91, ZK60, WE43, etc. according to JIS.

Each of the shoes may be comprised of a shoe substrate made of a magnesium-based material and a coating formed on the surface of the shoe substrate for improving the slidability. As the coating, it is possible to use the following (1) to (8), that is, (1) a sprayed layer of a metal able to improve the slidability such as a copper-based material or aluminum-based material (meaning aluminum or an aluminum alloy mostly containing aluminum, same below), (2) a sintered layer of a metal able to improve the slidability such as a copper-based material or aluminum-based material, (3) a coating layer comprised of polyamide imide (PAI), polyimide (PI), polyetheretherketone (PEEK), or another resin having a heat resistance of at least 130° C. in which is dispersed a solid lubricant such as molybdenum disulfide ($MOS_2$), graphite, tungsten disulfide ($WS_2$), boronitride (BN), and polytetrafluoroethylene (PTFE), (4) a plating layer of a metal able to improve the slidability such as tin plating, nickel-phosphorus plating, nickel-boron plating, nickel-phosphorus-boron plating, nickel-phosphorus-boron-tungsten (N—P—B—W) plating, nickel-phosphorus-boron-tungsten-chrome plating, and hard chrome plating, (5) an ion plating layer obtained by chemical vapor deposition (CVD) or physical vapor deposition (PVD) of a material able to improve the slidability such as titanium nitride (TiN), chrome nitride (CrN), and titanium-aluminum-nitride (TiAlN); (6) a layer comprised of diamond-like carbon (DLC) etc., (7) a ceramic coat, and (8) alumite. This coating may be the same or different between the flat part in sliding contact with the swash plate and the spherical part in sliding contact with the piston. Further, when not forming a coating on the flat part or spherical part of the shoe substrate, it is preferable to quench-harden the flat part or the spherical part.

Note that if a coating for improving the slidability is formed on the surface of the swash plate or the shoe seats of the pistons as well, it is possible to use one of the above coatings (1) to (8) different from the coating formed on the shoe substrates.

The swash plate compressor of the present invention is particularly effective in the case of a variable displacement type where the inclination angle of the swash plate is variable with respect to the drive shaft and the pressure inside the crank chamber is adjusted by a control valve so as to change the inclination angle of the swash plate and adjust the discharge capacity. That is, since the shoes are mainly comprised of a magnesium-based material, the inertia of the shoes acting in a direction increasing the inclination angle becomes smaller and the high speed control is improved.

Further, the swash plate compressor of the present invention is particularly effective in the case of a single-headed piston where the piston has a head at only one of the front and rear of the swash plate, that is, in the case of a single-headed piston type swash plate compressor. In this case, superior durability can be achieved under tough conditions regardless of whether the single-headed piston type swash plate compressor is a fixed displacement type or a variable displacement type.

Figure 3:
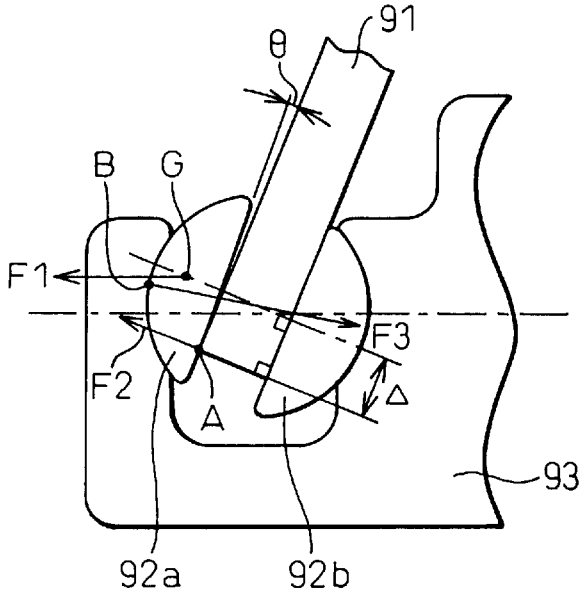
FIG. 3 is an enlarged sectional view of the principal parts of a swash plate, shoes, and a piston according to a general variable displacement single-headed piston type swash plate compressor.

That is, in a single-headed piston type swash plate compressor, as shown in FIG. 3, when the swash plate 91 is at the bottom dead center position, inertia F1, due to the weight of a shoe 92*a* which is located at the front side (left side in FIG. 3) of the swash plate 91 at the bottom center position, acts on the center of gravity G in the axial direction. Therefore, the shoe 92*a* receives a reaction force F3 corresponding to the resultant force of the inertial force F1 from the center of gravity G and a normal reaction force F2, which acts perpendicularly to a front side edge A and shifts by the direction Δ from the regular position towards the outside of the swash plate. Thus, the shoe 92*a* receives the force F3 at the position B that connects to the shoe seat placed in the front side of the piston. The inertia F1 differs according to the specific gravity of the shoe 92*a* and the rotational speed of the drive shaft, so the vertical force F2 also differs depending on the specific gravity of the shoe 92*a* and the rotational speed of the drive shaft. Therefore, if the shoe 92*a* is mainly comprised of a ferrous metal such as SUJ2 according to JIS having a large specific gravity, the mass of the shoe 92*a* becomes large and the swash plate 91, especially at the front side edge A, is easily worn. When employing a swash plate 91 formed with a coating for improving the slidability on the swash plate substrate, the coating is easily worn. As opposed to this, if the shoe 92*a* is mainly comprised by a magnesium-based material having a small specific gravity, the mass of the shoe 92*a* is small and the swash plate 91, in particular the coating, will not be easily worn.

Figure 4:
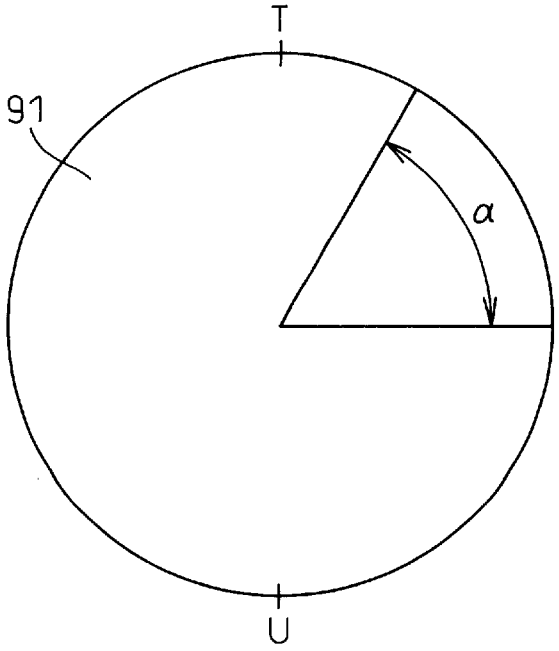
FIG. 4 is a schematic plan view of a swash plate, seen from the rear and in the axial direction, according to a general variable displacement single-headed piston type swash plate compressor.

Further, a shoe 92*b* at the rear side is pressed against the swash plate 91 by a load corresponding to the rotational angle. At this time, a differential pressure based on the difference between the pressure inside the compression chamber and the pressure inside the crank chamber and an inertia based on the weight of the shoe 92*b* itself act on the shoe 92*b* at the rear side. The resultant force of the differential pressure and the inertia becomes the load. The differential pressure does not change due to the specific gravity of the shoe 92*b*, but the inertia changes due to the specific gravity of the shoe 92*b*, so the load by which the rear side shoe 92*b* is pushed against the swash plate 91 changes depending on the specific gravity of the shoe 92*b*. This load changes according to the rotational angle. As shown in FIG. 4, when the load becomes 0 or minus (in the rear direction) at the start of the angular range α between the top dead center T and bottom dead center U, the rear side shoe 92*b* separates from the swash plate 91. When the load becomes a plus one (in the forward direction) at the end of the angular range α, the rear side shoe 92*b* strikes the swash plate 91. Here, the energy E when the shoe 92*b* strikes the swash plate 91 is expressed as follows when the mass of the shoe 92*b* is "m" and the speed of the shoe 92*b* is "v":

$$E=\frac{1}{2}mv^2$$

Therefore, a difference arises in the energy E depending on the mass of the shoe 92*b*.

Therefore, if the shoe 92*b* is mainly comprised of a ferrous metal having a large specific gravity such as SUJ2, since the mass of the shoe 92*b* is large, the energy when the shoe 92*b* strikes the swash plate 91 is large and the swash plate and, in particular, the coating are easily worn. As opposed to this, if the shoe 92*b* is mainly comprised by a magnesium-based material having a small specific gravity, since the mass of the shoe 92*b* is small, the energy when the shoe 92*b* strikes the swash plate 91 is small and the swash plate and, in particular, the coating are not easily worn.

Therefore, in this single-headed piston type swash plate compressor, it is possible to achieve even more superior durability.

Next, a specific embodiment of the present invention will be explained with reference to the drawings.

In the variable displacement single-headed piston type swash plate compressor of the present embodiment (hereinafter referred to simply as a "compressor"), as shown in FIG. 1, a front housing 2 is connected to the front end of the cylinder block 1. A crank chamber 2*a* is formed in a cylinder block 1 and the front housing 2. A rear housing 4 is connected to the rear end of the cylinder block 1 through a valve mechanism 3 comprised of a suction valve, valve plate, discharge valve, and retainer. A suction chamber 4*a* and a discharge chamber 4*b* are formed in the rear housing 4. The suction chamber 4*a* is connected to a not shown evaporator, the evaporator is connected through a not shown expansion valve to a not shown condenser, and the condenser is connected to the discharge chamber 4*b*.

The drive shaft 5 is rotatably supported at the front housing 2 and the cylinder block 1 through bearings 2*b*, 1*b*. A plurality of cylinder bores 1*a* parallel with the axis of the drive shaft 5 are formed in the cylinder block 1. A single-headed piston 6 is accommodated in each cylinder bore 1*a* to reciprocate therein.

A rotor 7 is fixed to the drive shaft 5 so as to be able to rotate in the crank chamber 2*a* through a bearing 2*c* adjacent to the front housing 2. The swash plate 8 is oscillatingly provided adjacent to the rotor 7 through a pair of hinge mechanisms K. A through hole 8*a* is formed in the swash plate 8. The drive shaft 5 is inserted through the through hole 8*a* while allowing oscillating movement of the swash plate 8. The pistons 6 are engaged with the swash plate 8 through each pair of shoes 9*a*, 9*b*. The pair of shoes 9*a*, 9*b* sandwiches the swash plate 8, and the flat surfaces of the shoes 9*a*, 9*b* contact the front and rear surfaces of the swash plate 8. The spherical surfaces of the shoes 9*a*, 9*b* contact a pair of the spherical shoe seats of the piston 6 to be accommodated therein.

Further, the rear housing 4 houses a control valve 10 connected to the suction chamber 4*a*, discharge chamber 4*b*, and crank chamber 2*a*. By adjusting the pressure in the crank chamber 2*a* by the control valve 10, it becomes possible to change the inclination angle of the swash plate 8 and to adjust the discharge capacity.

Figure 2:
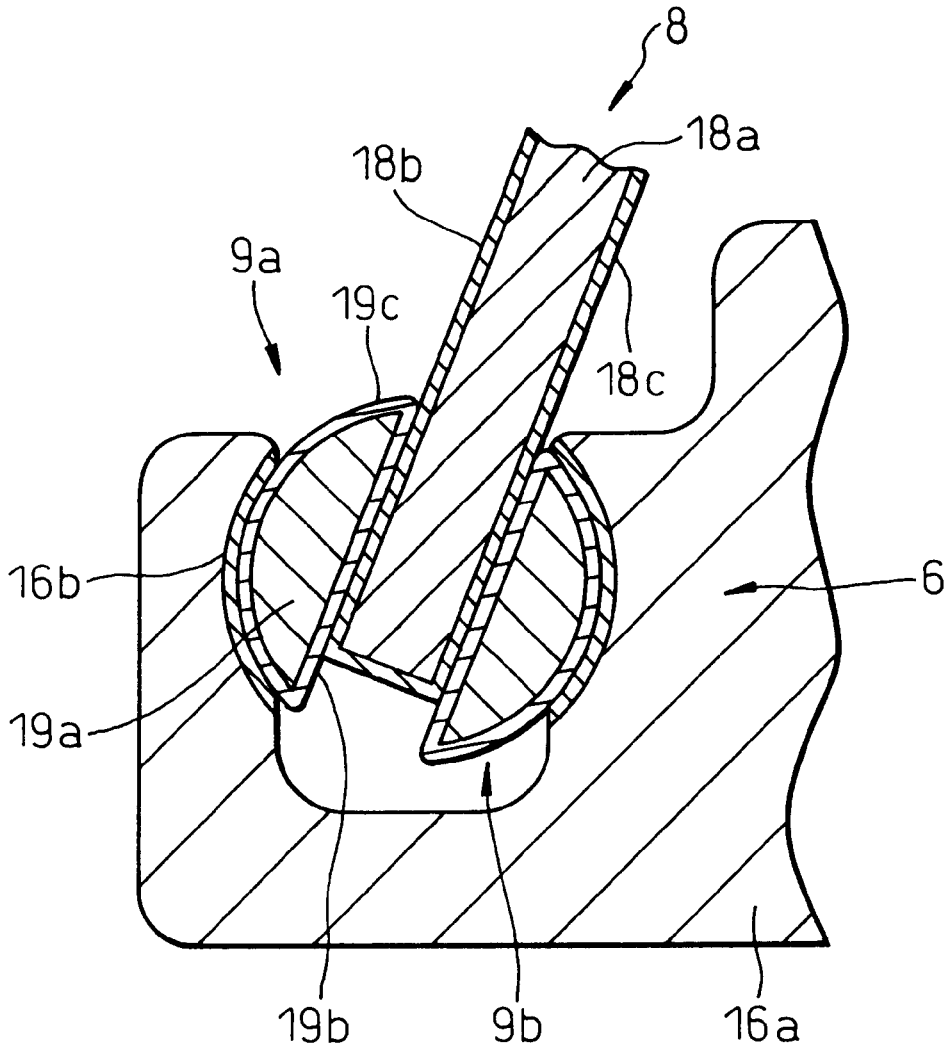
FIG. 2 is an enlarged sectional view of the principal parts of a variable displacement single-headed piston type swash plate compressor according to an embodiment of the present invention.

In the compressor of the above embodiment, as shown in FIG. 2, the swash plate 8 is comprised of a swash plate substrate 18*a* made of a ferrous metal and coatings 18*b*, 18*c* comprised of an aluminum sprayed layer and a resin coat formed on the front and rear surfaces of the swash plate substrate 18*a*. The structure shows a further formation of the latter coating on the former coating. Further, each of the front side and rear side shoes 9*a*, 9*b* is comprised of a shoe substrate 19*a* made of a magnesium-based material and coatings 19*b*, 19*c* made of an Ni—P—B—W (nickel-phosphorus-boron-tungsten) plating formed on the flat part and spherical part of the shoe substrate 19*a*. Further, each piston 6 is comprised of a piston substrate 16*a* made of an aluminum-based material and a coating 16*b* made of tin plating formed on the shoe seats of the piston substrate 16*a*.

Here, the ferrous material of the swash plate substrate 18*a* is SUJ2. The "aluminum sprayed layer" means a sprayed layer using Al—Si alloy as the aluminum-based material. The "resin coat" means a coating layer obtained by dispersing $MOS_2$ and graphite in PAI. Further, the magnesium-based material of the shoe substrate 19*a* is an Mg—Al alloy, for example, AZ91. Further, the aluminum-based material of the piston substrate 16*a* is an Al—Si alloy, for example, A4032 or ADC12.

The compressor configured in this way has a lower weight since the shoes 9*a*, 9*b* are mainly comprised of a magnesium-based material with a specific gravity of about 1.8.

Further, in this compressor, since the energy with which the shoes 9*a*, 9*b* strike the swash plate 8 is small and the mass of the shoes 9*a*, 9*b* is small, the coatings 18*b*, 18*c* on the swash plate substrate 18*a* will not be easily worn. Therefore, in this compressor, a more superior durability can be achieved.

Further, in this compressor, since the shoes 9*a*, 9*b* are mainly comprised of a magnesium-based material, the inertia of the shoes 9*a*, 9*b* acting in a direction increasing the inclination angle is small and the high speed control is improved.

Further, in this compressor, since the shoes 9*a*, 9*b*, in sliding contact with the pistons 6 mainly comprising an aluminum-based material, mainly comprise a magnesium-based material, it is possible to reliably prevent seizure.

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-214236, filed on Jul. 14, 2000, the disclosure of which is expressly incorporated herein by reference and in its entirety.

What is claimed is:

1. A swash plate compressor provided with a housing internally defining and forming cylinder bores, a crank chamber, a suction chamber, and a discharge chamber;

a piston accommodated in the each cylinder bore to be able to reciprocate in them;

a drive shaft driven by an external drive source and supported by said housing;

a swash plate synchronously rotatably supported with respect to said drive shaft; and a pair of shoes provided at a front and rear of the swash plate so as to be accommodated in the piston and to drive the piston; wherein the shoes are mainly comprised of a magnesium-based material.

2. A swash plate compressor as set forth in claim 1, wherein each shoe is comprised of a shoe substrate comprised of a magnesium-based material and a coating formed on the surface of the shoe substrate for improving a slidability.

3. A variable swash plate compressor provided with a housing internally defining and forming cylinder bores, a crank chamber, a suction chamber, and a discharge chamber;

a single-headed piston accommodated in the each cylinder bore to be able to reciprocate them;

a drive shaft driven by an external drive source and supported by said housing;

a swash plate synchronously rotatably supported with respect to said drive shaft; and a pair of shoes provided at a front and rear of the swash plate so as to be accommodated in the piston and to drive the piston; wherein the shoes are mainly comprised of a magnesium-based material; and an inclination angle of the swash plate is variable with respect to the drive shaft, and a pressure in the crank chamber can be adjusted to change the inclination angle and amount of discharge capacity.

4. A swash plate compressor as set forth in claim 1, wherein each shoe is comprised of a shoe substrate comprised of a magnesium-based material and coating formed on the surface of the shoe substrate for improving a slideability; and the piston is a single-headed piston having a head at only one of a front and a rear of the swash plate.

* * * * *